United States Patent [19]

Tierno et al.

[11] Patent Number: 4,809,479

[45] Date of Patent: Mar. 7, 1989

[54] SLAT WALL SYSTEM

[76] Inventors: Michael A. Tierno, 2324 Silver Oak Dr., Pittsburgh, Pa. 15220; G. Stephen Johnstonbaugh, 4779 AuSable Dr., Gibsonia, Pa. 15044

[21] Appl. No.: 222,492

[22] Filed: Jul. 21, 1988

[51] Int. Cl.[4] ..... E04C 1/10

[52] U.S. Cl. ..... 52/588; 211/189; 52/630; 52/36; 52/38; 248/220.2; 248/222.2

[58] Field of Search ..... 52/588, 36, 38, 630; 211/189, 87; 248/220.2, 222.2

[56] References Cited

U.S. PATENT DOCUMENTS

| | | | |
|---|---|---|---|
| 4,323,163 | 4/1982 | Johns | 211/189 |
| 4,430,087 | 12/1983 | Johns | 52/588 |
| 4,531,331 | 7/1985 | Itagaki | 52/38 |
| 4,674,240 | 6/1987 | Strausheim | 211/189 |
| 4,694,965 | 9/1987 | Parnell | 211/189 |

*Primary Examiner*—James L. Ridgill, Jr.
*Attorney, Agent, or Firm*—Parmelee, Miller, Welsh & Kratz

[57] ABSTRACT

A slat wall section includes a plurality of front horizontal members spaced from each other in a front plane. The front members having first and second horizontal edges, both of which have a rearwardly extending lip. Rear horizontal members having first and second horizontal borders are disposed in a rear plane, which is substantially parallel to the front plane. Each section includes first and second ends, with one rear member extending to the first end and one front member extending to the second end. Substantially parallel transverse connecting members extend between, and are generally perpendicular to, the front and rear members. At least one connecting member extends from each of the front members to a rear member. The connecting members are spaced from the first and second horizontal edges of the front members. A first connector defines the first end of the section, and includes a flange extending toward the front plane. The flange is generally parallel to the connecting members, and has a rim extending from the frontmost edge thereof toward the second end of the section. A second connector, defining the second end of the section, is disposed on the rear surface of the front member which extends to the second end of the section, and includes an L-shaped extension spaced from the second end and extending toward the rear plane. The extension is generally parallel to the connecting members, and the leg of the extension extends toward the first end of the section.

11 Claims, 2 Drawing Sheets

SLAT WALL SYSTEM

BACKGROUND OF THE INVENTION

The invention relates to a slat wall section and a slat wall system using such a section.

Slat walls have a front surface formed by horizontally elongated front members separated by horizontally elongated grooves. The grooves receive supports, such as braces and hangers, which, in turn, support shelves and the merchandise that is being displayed. Slat walls are used extensively for wall displays because of the versatility that they offer as far as placement of the supports to be mounted thereon.

Often slat walls are formed as extruded horizontally elongated slat wall sections that are interlocked with similar upper and lower slat wall sections to form a slat wall panel. Generally, the upper and lower horizontal ends of the slat wall sections have connectors which mesh with those of the vertically adjacent sections to secure the sections together. Several panels, in turn, are used to form a slat wall. It is important that the hooking engagement between vertically adjacent slat wall sections be such that the finished slat wall is sturdy. Further, the spacing between the front members of the slat wall sections should be uniform to maintain an asthetically pleasing appearance of the slat wall. In addition, the grooves in the slat wall should be designed to promote stable engagement between the slat wall and the supports that are mounted on the slat wall within the groove.

One such slat wall panel system, using extruded plastic units, is disclosed in U.S. Pat. No. 4,674,240. The lower edge of each slat wall panel unit includes a land which forms one side of an open-ended box B. The next adjacent side of the box is defined by an arm of the next adjacent channel. The third side of the box is provided by a wall which is integral with the arm. The fourth side of the box is a stub arm which depends from the land and terminates short of the wall to provide a gap therebetween. The upper edge of each slat wall panel unit includes a T-shaped flange. The flange engages endwise in the box of a vertically adjacent slat wall panel unit so that the units are securely locked together. The head of the "T" engages through the gap and against the wall of the lower edge of a vertically adjacent slat wall panel, and the stem of the "T", constituted by a rib, engages behind the stub arm. It is believed that adjacent such slat wall panel units must be secured together by placing the flange of one unit within the box of an adjacent slat wall panel unit from the side of the unit and sliding the units relative to each other until the sides of the units are coextensive.

It is desired to develop a slat wall system in which the engagement between vertically adjacent slat wall sections is sturdy, and in which the engagement does not interfere with uniform spacing between the front members. Because slat wall sections can be on the order of six feet long, the sections are difficult for one person to handle while engaging the connectors of vertically adjacent slat wall sections from the side and sliding the sections relataive to each other until the sides of the sections are coextensive. Therefore, it would be desirable to be able to hook adjacent members together from the front or back.

SUMMARY OF THE INVENTION

The slat wall section of the present invention includes a plurality of front horizontal members and at least one rear member. First and second horizontal edges of the front members have a rearwardly extending lip, while rear members have first and second horizontal borders. The front members are spaced from each other in a front plane, and each of the rear members is in a rear plane, which is substantially parallel to the front plane.

The slat wall section further includes first and second ends. A rear member extends to the first end of the slat wall section, while one of the front members extends to the second end of the slat wall section.

A plurality of substantially parallel transverse connecting members extend between, and generally perpendicularly to, the front members and a rear member. At least one connecting member extends from each of the front members to a rear member. The connecting members are spaced from the first and second horizontal edges of the front members.

A first connector, defining the first end of the slat wall section, includes a flange extending from the lowermost border of the rear member closest to the first end of the slat wall section toward the front plane. The flange is generally parallel to the connection members and has a rim extending from the front-most edge thereof toward the second end of the slat wall section.

A second connector, defining the second end of the slat wall section, is disposed on the rear surface of the front member which extends to said second end of the slat wall. The second connector includes an L-shaped extension spaced from the second end and extending toward the rear plane, which extension is generally parallel to the connecting members. The leg of the L-shaped extension extends toward the first end of the slat wall section.

The first and second connectors of vertically adjacent slat wall sections coact to hook the slat wall sections together. The L-shaped extension, specifically the leg of the L-shaped extension, of the second connector of one slat wall section engages the flange, specifically the rim of the flange, of the first connector of the other slat wall section. Adjacent slat wall sections are securely hooked together to form a sturdy, uniform slat wall wall panel by engaging the first and second connectors of the adjacent sections together. It should be noted that adjacent sections can be hooked together from the front or back, and do not require sliding engagement from the side.

DESCRIPTION OF THE DRAWINGS

Other objects and advantages of the present invention will become readily apparent upon reference to the following drawings wherein.

DETAILED DESCRIPTION OF THE PREFERRED EMBODIMENTS

Figure 1:
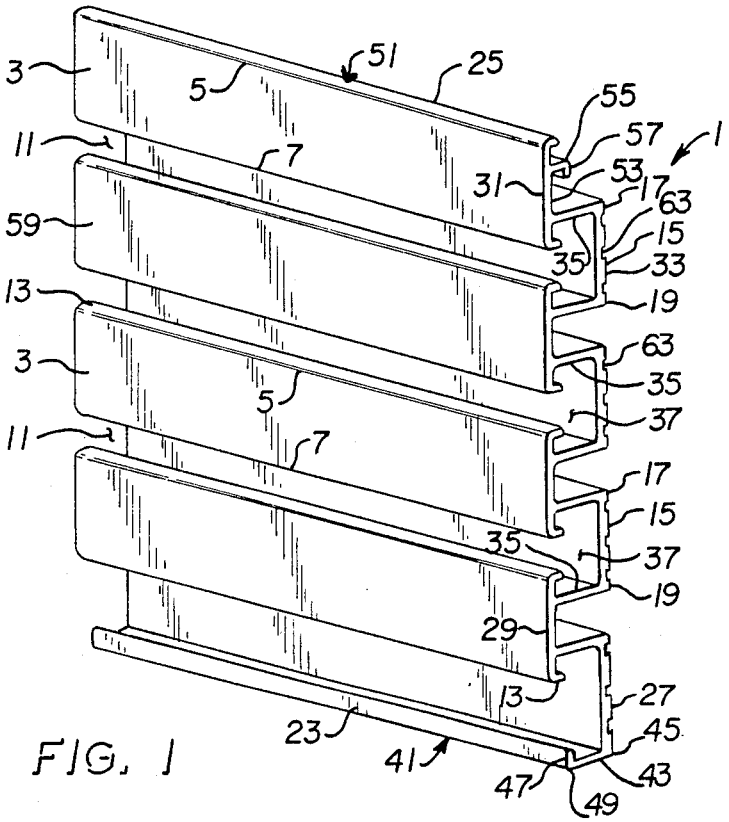
FIG. 1 is a perspective view of the front of the slat wall section of the invention.
Figure 2:
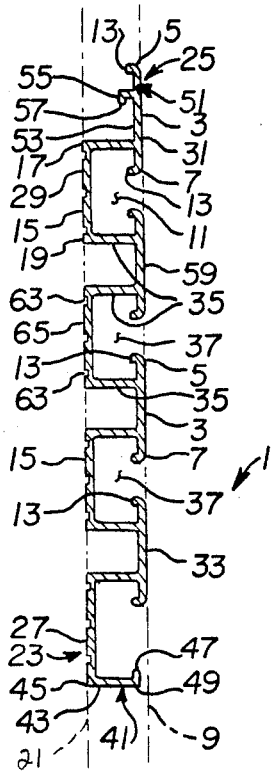
FIG. 2 is a cross-sectional view of the slat wall section of FIG. 1.
Figure 3:
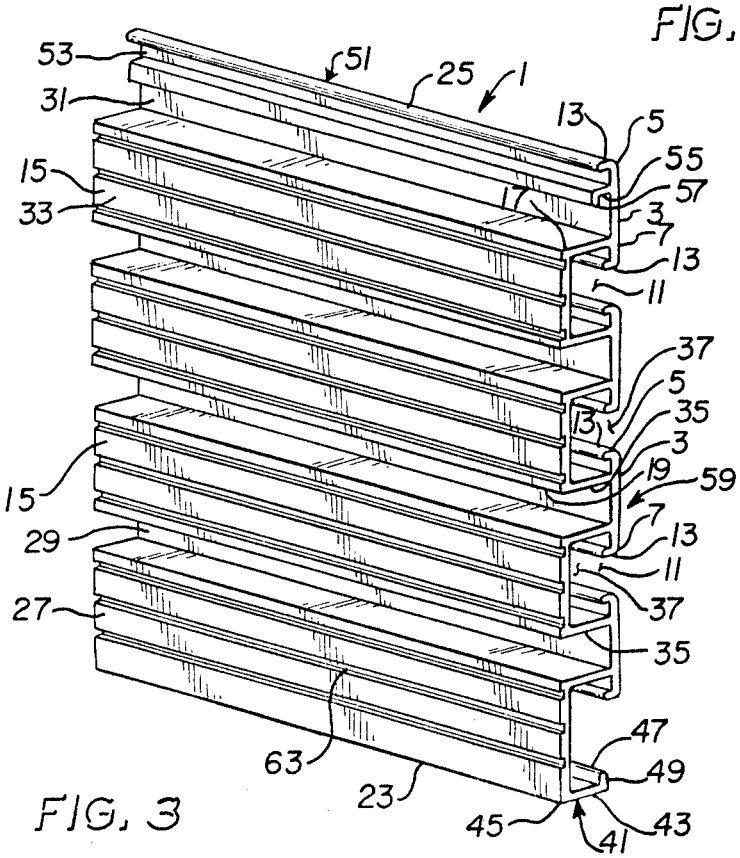
FIG. 3 is a perspective view of the rear of the slat wall section of FIG. 1.

The slat wall section 1 of the invention includes a plurality of front horizontal members 3. These front members 3 have first and second horizontal edges, 5 and 7, respectively and are spaced from each other in a front plane 9 (FIG. 2) by gaps 11. Both of the first and second edges 5 and 7 of the front members 3 have a rearwardly extending lip 13. Preferably, the slat wall section 1 includes four front members 3.

The slat wall section 1 also includes at least one rear member 15. The rear members 15 have first and second horizontal borders, 17 and 19, respectively, and are oriented in a rear plane 21, (FIG. 2) which is substantially parallel to the front plane 9. Preferably, the slat wall section 1 includes a plurality of spaced rear horizontal members 15. More preferably, the slat wall section 1 includes four rear members 15.

The slat wall section 1 further includes first and second ends, 23 and 25, respectively. One of the rear members 15, illustrated as the lowermost rear member 15 and identified with the reference numeral 27, extends to the first end 23 of the slat wall section 1. Preferably, the front member 3 closest to the first end 23, identified with the reference numeral 29, is spaced from the first end 23. One of the front members 3, illustrated as the topmost front member 3 and identified with the reference numeral 31, extends to the second end 25 of the slat wall section 1. Preferably, the rear member 15 closest to the second end 25, identified with the reference numeral 33, is spaced therefrom.

A plurality of substantially parallel transverse connecting members 35 extend between, and are generally perpendicular to, the front members 3 and the rear member 15, with at least one of the connecting members 35 extending from each of the front members 3 to a rear member 15. The connecting members 35 are spaced from the first and second horizontal edges 5 and 7 of the front members 3. Preferably, one connecting member 35 extends from the front member 29 to the rear member 27 and two connecting members 35 extend from each of the other front members 3. More preferably, one of the connecting members 35 extending from a front member 3 extends to one rear member 15, and the other of the connecting members 35 extending from the front member 3 extends to the adjacent rear member 15. The connecting members 35 generally extend to the first and second borders 17 and 19 of the rear members 15.

Vertically adjacent front members 3 are separated from each other and from the corresponding rear member 15 by generally C-shaped grooves 37. The C-shaped grooves 37 are defined by the front members 3, the rear member 15 behind the gap 11 between the adjacent front members 3, and the connecting members 35 extending from the adjacent front members 3 to the rear member 15.

When the slat wall sections 1 are formed into a slat wall panel 39 and slat wall, various supports, such as braces and hangers, are supported within the C-shaped grooves 37. The lips 13 on the front members 3 of the slat wall section 1 provide additional stability to hold the support within the C-shaped groove 37.

A first connector 41 defines the first end 23 of the slat wall section 1, and includes a flange 43 extending from the lowermost border 45 of the rear member 27 that is closest to the first end 23 toward the front plane 9. The flange 43 is generally parallel to the connecting members 35, and has a rim 47 extending from the frontmost edge 49 thereof toward the second end 25 of the slat wall section 1.

A second connector 51, defining the second end 25 of the slat wall section 1, is disposed on the rear surface 53 of the front member 31 which extends to the second end 25 of the slat wall section 1. The second connector 51 is an L-shaped extension 55 spaced from the second end 25 and extending toward the rear plane 21, which extension 55 is generally parallel to the connecting members 35. The leg 57 of the L-shaped extension 55 extends toward the first end 23 of the slat wall section 1.

Figure 4:
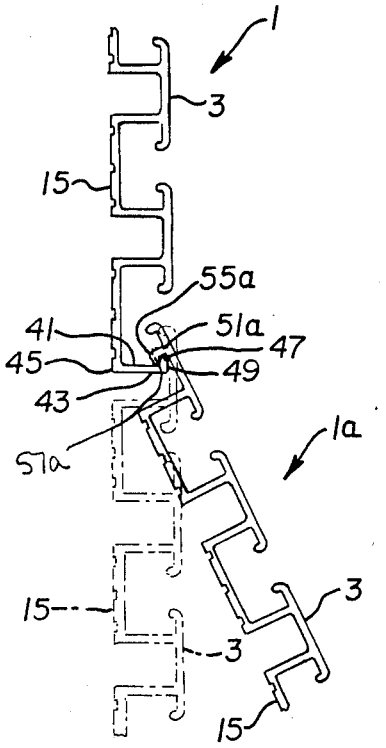
FIG. 4 is a cross-sectional view of two slat wall sections in position to be hooked together and showing them hooked together in phantom.
Figure 5:
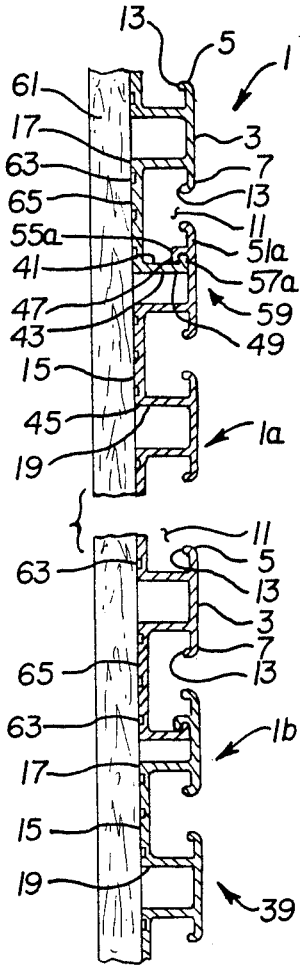
FIG. 5 is a cross-sectional view of three foreshortened slat wall sections hooked together and mounted on a vertical support to form a slat wall panel.

As illustrated in FIGS. 4 and 5, the first connector 41 of a slat wall section 1 coacts with the second connector **51*a* of a vertically adjacent slat wall section 1*a* to hook adjacent slat wall sections 1 and 1*a* together. The L-shaped extension 55*a* of the second connector 51*a* of the slat wall section 1*a* engages the flange 43 and rim 47 of the first connector 41 of the adjacent slat wall section 1. In particular, the interlocking of the leg 57*a* of the L-shaped extension 55*a* of the second connector 51*a* with the rim 47 of the flange 43 of the first connector 41 provides a stable engagement of two adjacent slat wall sections 1 and 1*a***.

It is apparent from FIGS. 4 and 5 that vertically adjacent slat wall sections 1 and **1*a* can be engaged from the front or back of the slat wall sections 1 and 1*a* by interlocking the L-shaped extension 55*a* of the second connector 51*a* of the slat wall section 1*a* with the flange 43 of the first connector of the slat wall section 1 along the entire length thereof at one time. It is not necessary to engage the first and second connectors 41 and 51*a* of the adjacent slat wall sections 1 and 1*a* from a side and slide the slat wall sections 1 and 1*a* relative to each other until the sides are coextensive. However, the slat wall sections 1 and 1*a*** can be engaged in that way.

The slat wall section 1 of the invention can be any desired size. Generally, such slat wall sections 1 are on the order of about six inches high and about six feet long. Slat wall panels 39, formed of several slat wall sections 1, can be any desired size as well, but are typically about two feet high and about six feet long. A slat wall, formed of several slat wall panels 39, can be on the order of eight feet high.

The first and second connectors 41 and 51 are designed so that, when several of the slat wall sections 1 are assembled together to form a slat wall panel 39, one looking at the front surface 59 of the slat wall sections 1 can not determine where the slat wall sections 1 are hooked together. The gaps 11 between all of the front members 3 are uniform, and all of the front members 3 lie in the front plane 9.

The slat wall section 1 may be formed of a variety of materials, such as a metal extrusion of aluminum. The extrusions can then be coated, such as by powder coating technology, in a variety of colors to present an eye-catching slat wall as background for the material being displayed from the slat wall.

The slat wall sections 1 are mounted on a vertical support 61 to form a slat wall panel 39. As shown in FIG. 5, the rear members 15 of the slat wall sections 1, **1*a* and 1*b* can be secured to a vertical support 61 of compressed particle board. Several slat wall panels 39 can be used to form an entire slat wall. The slat wall sections 1 are preferably secured to the vertical support 61 by means such as an adhesive. It is desired to avoid the use of securing devices, such as screws, which would show, and require additional labor for installation. However, such securing devices can be used. The rear members 15 can include horizontal grooves 63 in the rear surface 65 of the rear member 15** to aid in the use of the adhesive.

Vertically adjacent slat wall sections 1 of the invention, through the first and second connectors 41 and 51, are securely hooked together to form a sturdy, uniform slat wall panel 39.

What is claimed is:

1. A slat wall section comprising:

a plurality of front horizontal members spaced from each other in a front plane, said front members having first and second horizontal edges, both of said first and second edges having a rearwardly extending lip, at least one rear horizontal member, each said rear member being in a rear plane and having first and second horizontal borders, said rear plane being substantially parallel to said front plane, a first end of said slat wall section, said rear member extending to said first end, a second end of said slat wall section, one of said front members extending to said second end, a plurality of substantially parallel transverse connecting members extending between, and generally perpendicularly to, said front members and said at least one rear member, with at least one connecting member extending from each of said front members to said at least one rear member, said connecting members being spaced from said first and second horizontal edges of said front members, a first connector, defining said first end of said slat wall section, comprising a flange extending toward said front plane and being generally parallel to said connecting members, said flange having a rim extending from the frontmost edge thereof toward said second end of said slat wall section, and a second connector, defining said second end of said slat wall section, disposed on the rear surface of the front member which extends toward said second end of said slat wall section comprising an L-shaped extension spaced from said second end and extending toward said rear plane, said extension being generally parallel to said connecting members, with the leg of said L-shaped extension extending toward said first end of said slat wall section.

2. The slat wall section of claim 1 in which the rear member closest to said second end is spaced therefrom, and the front member closest to said first end is spaced from said first end.

3. The slat wall section of claim 1 in which said slat wall is formed as a metal extrusion.

4. The slat wall section of claim 1 in which said slat wall section includes four front horizontal members.

5. The slat wall section of claim 1 in which said slat wall section comprises a plurality of spaced rear horizontal members.

6. The slat wall section of claim 5 in which said connecting members extend from said first and second borders of said rear horizontal members.

7. The slat wall section of claim 6 in which one said connecting member extends from said front member closest to said second end of said slat wall section and two said connecting members extend from each of the other said front members.

8. A slat wall section comprising:

a plurality of front horizontal members spaced from each other in a front plane, said front members having first and second horizontal edges, both of said first and second edges having a rearwardly extending lip, a plurality of rear horizontal members, each said rear member being in a rear plane and having first and second horizontal borders, said rear plane being substantially parallel to said front plane, a first end of said slat wall section, with a first said rear member extending to said first end and the front member closest to said first end being spaced from said first end, a second end of said slat wall section, with one of said front members extending to said second end and the rear member closest to said second end being spaced therefrom, a plurality of substantially parallel transverse connecting members extending between, and generally perpendicularly to, said front members and said rear members, one said connecting member extending from said front member closest to said second end of said slat wall section and two said connectng members extending from each of the other said front members, said connecting members being spaced from said first and second horizontal edges of said front members, and extending from said first and second borders of said rear members, a first connector, defining said first end of said slat wall section, comprising a flange extending toward said front plane and being generally parallel to said connecting members, said flange having a rim extending from the frontmost edge thereof toward said second end of said slat wall section, and a second connector, defining said second end of said slat wall section, disposed on the rear surface of the front member which extends toward said second end of said slat wall section comprising an L-shaped extension spaced from said second end and extending toward said rear plane, said extension being generally parallel to said connecting members, with the leg of said L-shaped extension extending toward said first end of said slat wall section.

9. The slat wall section of claim 8 in which there are four front horizontal members and four rear horizontal members.

10. A slat wall comprising:

a vertical support;

a plurality of slat wall sections, each said slat wall section comprising;

a plurality of front horizontal members spaced from each other in a front plane, said front members having first and second horizontal edges, both of said first and second edges having a rearwardly extending lip, at least one rear horizontal member, each said rear member being in a rear plane and having first and second horizontal borders, said rear plane being substantially parallel to said front plane, a first end of said slat wall section, said rear member extending to said first end, a second end of said slat wall section, one of said front members extending to said second end, a plurality of substantially parallel transverse connecting members extending between, and generally perpendicularly to, said front members and said at least one rear member, with at least one connecting member extending from each of said front members to said at least one rear member, said connecting members being spaced from said first and second horizontal edges of said front members, a first connector, defining said first end of said slat wall section, comprising a flange extending toward said front plane and being generally parallel to said connecting members, said flange having a rim extending from the frontmost edge thereof toward said second end of said slat wall section, a second connector, defining said second end of said slat wall section, is disposed on the rear surface of the front member which extends toward said second end of said slat wall section and comprises an L-shaped extension spaced from said second end and extending toward said rear plane, said extension being generally parallel to said connecting members, the leg of said L-shaped extension extending toward said first end of said slat wall section, said plurality of slat wall sections being hooked together by engagement of the first connector of one slat wall section with the second connector of a vertically adjacent slat wall section, and wherein said rear members of said slat wall sections are secured to said vertical support.

11. The slat wall of claim 10 wherein said vertical support is compressed particle board.

* * * * *